United States Patent [19]

Diebel et al.

[11] 4,334,547

[45] Jun. 15, 1982

[54] WASHING MACHINE FOR GLASSES AND THE LIKE

[75] Inventors: Howard Diebel, St. Catharines; Albert deMan, Vineland, both of Canada

[73] Assignee: Moyer Diebel Limited, Jordan Station, Canada

[21] Appl. No.: 140,371

[22] Filed: Apr. 14, 1980

[30] Foreign Application Priority Data

Apr. 20, 1979 [CA] Canada ..... 326022

[51] Int. Cl.[3] ..... B08B 3/02

[52] U.S. Cl. ..... 134/46; 134/131

[58] Field of Search ..... 134/46–49, 134/52–53, 56 R, 56 D, 131

[56] References Cited

U.S. PATENT DOCUMENTS

| | | | |
|---|---|---|---|
| 2,610,642 | 9/1952 | D'Aurora | 134/46 X |
| 2,764,170 | 9/1956 | Messler et al. | 134/46 |
| 2,986,268 | 5/1961 | Robson et al. | 134/46 X |

*Primary Examiner*—Robert L. Bleutge

*Attorney, Agent, or Firm*—Hirons, Rogers & Scott

[57] ABSTRACT

A machine for washing drinking glasses has a conveyor upon which the glasses are conveyed from a loading zone through wash and rinse zones to an unloading zone. The machine may be operated on a continuous basis or it may be operated on a timed cycle basis, or it may be operated intermittently, being stopped by detector mechanism sensing the arrival of a glass at the unloading zone.

9 Claims, 5 Drawing Figures

WASHING MACHINE FOR GLASSES AND THE LIKE

FIELD OF THE INVENTION

This invention is concerned with washing machines of the kind in which drinking glasses or other utensils are carried through wash and rinse zones on a conveyor.

REVIEW OF THE PRIOR ART

These machines are commonly found in bars and restaurants and usually comprise a cabinet which houses a conveyor, most usually an endless belt conveyor of which the belt is of open mesh structure, a drive mechanism for the conveyor and spray units which direct detergent, rinsing and sanitizing fluids through the belt into the interiors of the glasses carried, upside down, on the belt. Spray units may be provided to direct the fluids onto the glasses or other utensils from above or from the sides of the belt.

Operators of these machines will conventionally load the moving conveyor at one end and remove the cleansed utensils at the opposite end, the conveyor being switched on and off as required by the operator. As soon as the conveyor is switched on the sprays become operative and unless the operator is diligent the machine is often left running when no utensils are to be washed which is wasteful of both energy and water resources.

DEFINITION OF THE INVENTION

Applicant herein seeks to provide a washing machine which may be operated in a selected one of three different modes so that energy and water may be conserved.

According to the present invention there is provided a washing machine for glasses and other utensils, the machine having a loading zone, a washing zone and an unloading zone;

the machine having at the washing zone spray means for directing cleaning fluids onto the said glasses and other utensils;

the machine having a conveyor operable to convey glasses and other utensils placed thereon through the said loading, washing and unloading zones in the stated order, and including switch means operable by control means for controlling the operation of the conveyor for the conveyance of the glasses and other articles through the zones and for controlling the operation of the spray means at the working zone to work the glasses and other articles passing through that zone;

the said control means including a timed cycle mechanism causing the operation of the conveyor and of the spray means for a timed cycle period related to the distance of travel of the conveyor to convey glasses and other articles from the loading zone to the unloading zone and then stop the conveyor and the spray means;

the said control means including a control member that in one condition permits the operation of the said timed cycle mechanism, that in another condition disables the said timed cycle mechanism for operation of the conveyor and the spray means by a manual control connected to the control means and operable by a human operator, and that in a further condition disables the same timed cycle mechanism for operation of the conveyor and the spray means by a movable glass and other article detector disposed in the path of the conveyor at the unloading zone and connected to the control means for operative movement thereof to stop the conveyor and the spray means by corresponding engagement of a glass and other article with the said moveable detector.

Most desirably it will be seen that there is provided a machine which may be operated continuously, which may be operated on a timed cycle or which may be operated so as to be switched off automatically as a utensil reaches an unloading zone of the conveyor.

In each instance the control means may be preset at the factory, set upon installation or set at the will of an operator.

DESCRIPTION OF THE DRAWINGS

A machine which is a particular preferred embodiment of the present invention is illustrated schematically in the accompanying drawings, in which.

DESCRIPTION OF THE PREFERRED EMBODIMENT

Figure 1:
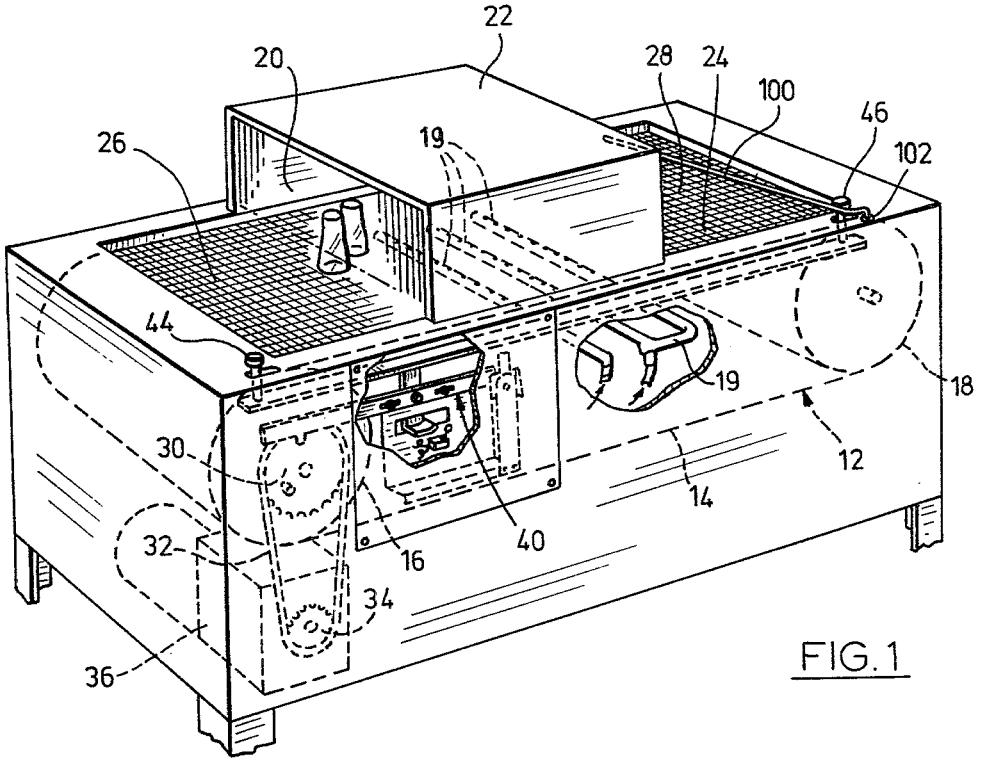
FIG. 1 is a perspective view of the machine according to the present invention, parts thereof being shown broken away as necessary for clarity of illustration.

The washing machine comprises a cabinet 10 in which is mounted an endless belt conveyor 12 comprising a belt 14 and drive and idler rolls 16 and 18 respectively. The belt 14 is of open construction so that spray means 19 of any conventional form may be disposed to direct different cleansing liquids as, for example, detergents, rinse water and sanitizers, into a cleansing wash and rinse zone 20 covered by a tunnel structure 22. The upper course 24 of the belt 14 provides the article-carrying surface and defines a loading zone 26 at its left hand end (as viewed in the drawings) and an unloading zone 28 at its right hand end, the wash and rinse zone being disposed between the loading and unloading zones. The drive end of drive roll 16 has a sprocket 30 about which a chain 32 is trained, the chain also being trained about a sprocket 34 of a drive motor and gearbox indicated generally by 36 and by which the conveyor is driven.

A control mechanism for the machine is indicated generally at 40 and is described in greater detail with reference to FIGS. 2 through 5. A slide bar 42 is mounted in the cabinet 10 for longitudinal back and front sliding movement parallel to the direction of travel of the belt 14. An on/off knob 44 is provided at the loading end of the conveyor, projecting upwardly from the bar 42 and secured thereto, while a similar knob 46 is provided at the unloading end, the knobs being slidable in elongated openings 48 and 50 respectively in the top wall of the cabinet 10.

A post 52 having a ramp 54 at its lower end projects downwardly from the slide bar, which ramp cooperates with the actuating arm 56 of a microswitch 58. The microswitch 58 is fixedly mounted upon a sub-frame assembly 60 and the ramp 54 projects through a window 62 in that assembly to cooperate with arm 56. An operating bar or lever 66 is pivoted to the post 52 about a pin 64, the bar 66 moving longitudinally back and forth with the slide bar 42 and being guided in such movement by pins 68 and 70 secured to assembly 60 and passing through elongated holes 72 and 74 respectively in the bar 66. As can be seen particularly in FIG. 5, the pins 68 and 70 are received with play within the holes 72 and 74 respectively. A downwardly-projecting dog 76 is formed towards the end of bar 66 adjacent to sprocket 30 for cooperation with a peg 78 eccentrically secured to the sprocket 30. The purpose of this arrangement is described hereinafter.

Secured to the sub-assembly 60 is an upstanding post 80 having a generally T-shaped selector element 82 pivoted at its upper end about pivot pin 84. The upper end of the structure is more clearly visible in FIG. 5. The T-shaped selector element 82 has an upstanding flange 86 at one end of the T cross-bar, which flange cooperates with upper portions of side edges 88 and 90 of post 80, and with top edge 92 of that post, the actual engagement of the flange 86 with these edges being via a contact block 93. The corners of the upper end of the post are relieved to permit the pivoting movement of element 82 which has a spring-operated over-center type action, so that it is held in the selected one of the three different positions of that element into which it is placed by an operator, as shown respectively in FIGS. 2, 3 and 4. Thus, a coil spring 98 is connected between foot portion 94 of the T-shaped selector element and end 96 of the bar 66.

Figure 4:
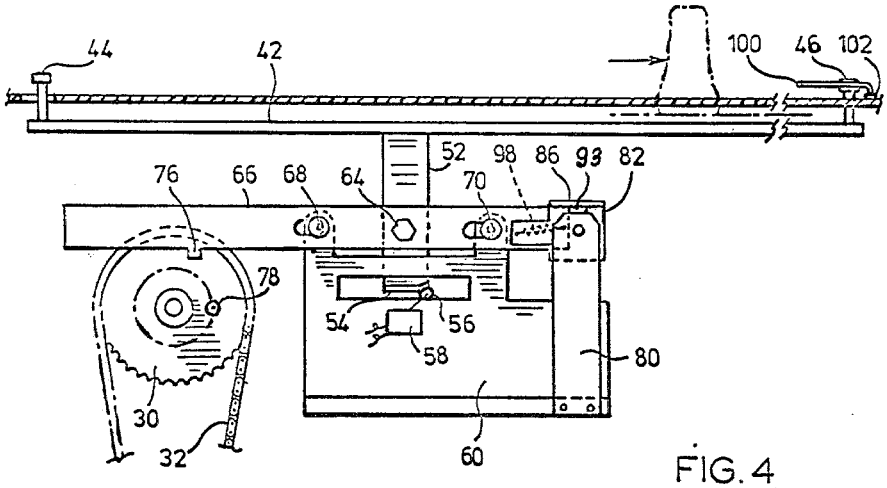
Figure 5:
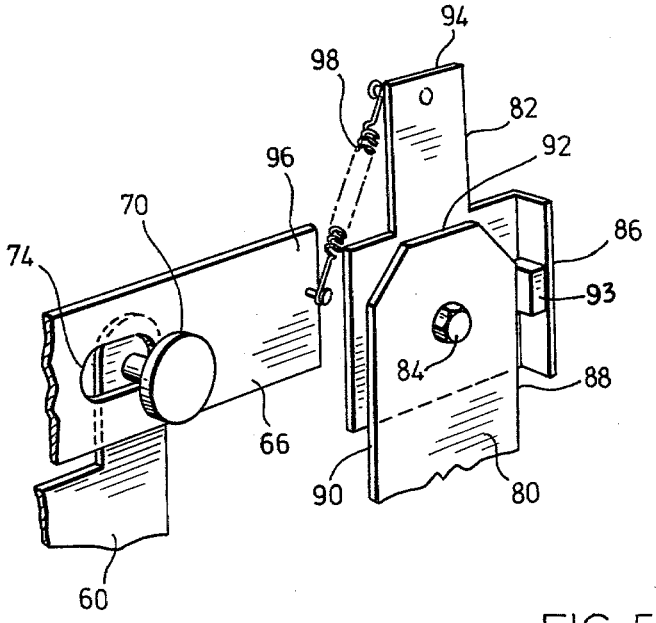
FIG. 5 is an exploded view of a detail of the control mechanism of FIGS. 2 through 4.

As can be seen in FIGS. 1 and 4, a stop arm 100 is pivoted in a bushing 102 secured in the top surface of cabinet 10 and extends across the glass-carrying upper course 24 of the conveyor so as to be contacted by a glass that reaches the unloading end of the conveyor. The arm is loosely received within the bushing 102 so that it may be removed easily as desired. The arm extends across the knob 46 so that as it is pivoted clockwise (when viewed from above in FIG. 1) it causes the knob 46 and drawbar 42 to be moved from left to right In the position of the T-shaped selector element 82 shown in FIG. 2 the selector mechanism is set so that the machine operates for a timed cycle of predetermined extent. The spring 98 biases the bar 66 for counterclockwise movement about pivot 64, to the extent permitted by pins 68 and 70 so that the dog 76 is brought downward into the path of the peg 78. At the start of a cycle the peg 78 will be in a position somewhat to the right of that shown in FIG. 2 and when the drawbar is moved from right to left the dog can move over the peg. The movement of the knobs 44 and 46 and arm 66 from right to left is facilitated by the flexing of spring 98 which permits dog 76 to ride over peg 78. The cam 54 moves with the bar away from the microswitch 58 (see FIG. 1), which is normally closed, and is therefore able to complete the circuit to the motor for driving the conveyor and to the pumps which supply the spray means. The sprocket 30 will then complete a full revolution within the required period of time, which will bring the peg 78 into engagement with dog 76, moving bar 66 from left to right and causing the switch actuating arm 56 to be depressed and the microswitch 58 to be opened, rendering the spray means and conveyor inoperative. Thus, after a cycle, related to a particular distance of travel of the conveyor belt the conveyor and the spray means will be stopped and to be reactivated the knob 44 or the knob 46 must again be operated to move the bar 66 from right to left. When the apparatus is operating in this manner the trip lever 100 could be removed.

Figure 2:
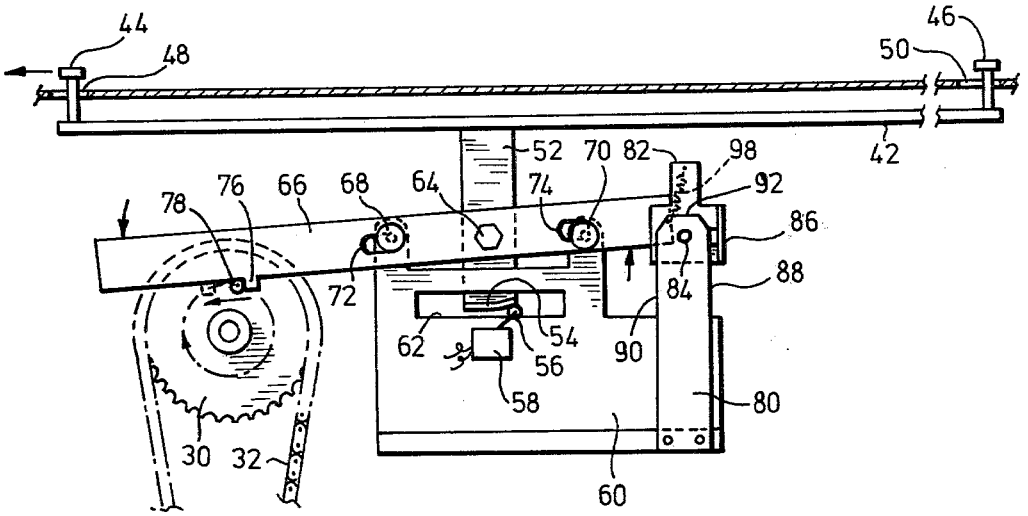
FIGS. 2, 3 and 4 are similar elevational views of the control mechanism of the machine of FIG. 1, showing the mechanism in different positions to give respective control functions.
Figure 3:
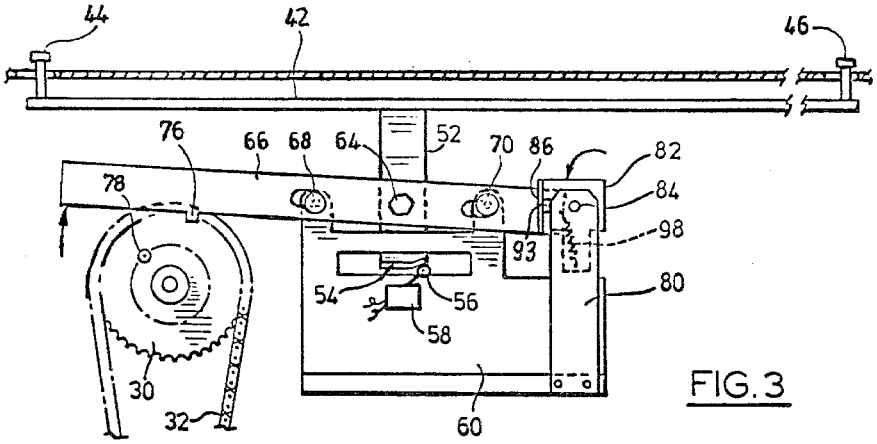

When the T-shaped selector element is moved through 180° from the position shown in FIG. 2 to the position shown in FIG. 3 the selector mechanism is set for continuous operation under the control of the operator. Thus, the spring 98 causes the bar 66 to be pivoted clockwise as viewed in FIG. 3 to the maximum extent permitted by the pins 68 and 70, so that the dog 76 is removed from the orbit path of the peg 78. Thus, when the operating knob 44 or 46 is moved to the left the bar 66 and cam 54 are also moved, closing the switch 58, whereupon the conveyor and spray means will continue to operate until such time as the knobs are moved to the right-hand off position. Also when operating in the condition shown in FIG. 3 the stop lever 100 could be removed.

With the T-shaped selector element in the middle position shown in FIG. 4, which is 90° from the positions shown in FIGS. 2 and 3, the spring 98 will bias the bar 66 for movement from right to left to the maximum extent permitted by the pins 68 and 70. In this position as a glass or other utensil reaches the stop lever 100 it will cause that lever to engage the knob 46 and move the slidebar 42, and with it the bar 66, from left to right against the action of the spring. The cam 54 will cause the operating lever of the microswitch 58 to be depressed and that switch opened to interrupt the operation of the conveyor and spray means pumps. Thereafter, as the glass is removed the spring will move the bar 66 from right to left permitting the microswitch to be opened and energizing the conveyor and spray pumps and returning the stop lever to its original position to await the arrival of another glass.

The control element 82 would be placed in a selected position either at the factory or upon installation of the apparatus and may be changed at will by the operator.

We claim:

1. A washing machine comprising a conveyor for conveying glasses and other utensils from a loading zone, through a washing zone including spray means to an unloading zone and control means associated with said spray means and conveyor means operable selectively to permit the continuous operation of the spray means and conveyor, to permit the intermittent operation of the spray means and conveyor on a timed cycle and to permit intermittent operation of the spray means and conveyor means to providing means sensing the arrival of a glass or utensil at the unloading zone of the conveyor means and effective to switch off the spray means and conveyor means in response to such arrival, wherein said control means comprise a slide bar mounted for longitudinal movement;

a pivoted lever mounted for movement with the slide bar;

a switch that in one state permits operation of the conveyor and the spray means and not in another state, movement of the slide bar in one direction operating the switch to one state and in the other direction operating the switch to the other state, and means for alternatively moving the said pivoted lever between;

a first position in which it engages a timing device that will move the lever and the slide bar to operate the switch after a predetermined period of time;

a second position in which the lever is movable by hand alone to operate the switch, and a third position in which the lever is urged to operate the switch to operate the conveyor and the spray means until moved in the opposite direction by a conveyed glass engaging a stop member coupled in the slide bar.

2. A washing machine as claimed in claim 1, wherein said means for alternatively moving the pivoted lever comprises a rotatable member rotatable between respective first, second and third positions and a spring connected between the pivoted lever and the rotatable member, in the first position the spring urging the lever to rotate about its pivot for engagement with said timing device, in the second position the spring urging the lever to rotate about its pivot for disengagement from the said timing device, and in the third position the spring urging the said lever and the slide bar in the direction for actuation of the switch for operation of the conveyor and the spray means.

3. A washing machine as claimed in claim 2, wherein the said timing device is a rotatable member rotatable with movement of the conveyor, a peg mounted by the rotatable member for movement in an orbit about the axis of rotation of the rotatable member, and a dog carried by the lever for engagement with the peg for movement thereby to actuate the switch and stop operation of the conveyor and the spray means.

4. A washing machine as claimed in claim 2, wherein the said spring provides an over-centre action to the said rotatable member to maintain it in the position into which it is placed by an operator.

5. A washing machine for glasses and other utensils, the machine having a loading zone, a washing zone and an unloading zone;

the machine having at the washing zone spray means for directing cleaning fluids onto the said glasses and other utensils;

the machine having a conveyor operable to convey glasses and other utensils placed thereon through the said loading, washing and unloading zones in the stated order, and including switch means operable by control means for controlling the operation of the conveyor for the conveyance of the glasses and other articles through the zones and for controlling the operation of the spray means at the washing zone to wash the glasses and other articles passing through that zone;

the said control means including a timed cycle mechanism causing the operation of the conveyor and of the spray means for a timed cycle period related to the distance of travel of the conveyor to convey glasses and other articles from the loading zone to the unloading zone and then stop the conveyor and the spray means;

the said control means including a control member that in one condition permits the operation of the said timed cycle mechanism, that in another condition disables the said timed cycle mechanism for operation of the conveyor and the spray means by a manual control connected to the control means and operable by a human operator, and that in a further condition disables the said timed cycle mechanism for operation of the conveyor and the spray means by a movable glass and other article detector disposed in the path of the conveyor at the unloading zone and connected to the control means for operative movement thereof to stop the conveyor and the spray means by corresponding engagement of a glass and other article with the said movable detector.

6. A washing machine as claimed in claim 5, wherein said control means comprise a slide bar mounted for longitudinal movement;

a pivoted lever mounted for movement with the slide bar;

a switch that in one state permits operation of the conveyor and the spray means and not in another state, movement of the slide bar in one direction operating the switch to one state and in the other direction operating the switch to the other state, and means for alternatively moving the said pivoted lever between;

a first position in which it engages a timing device that will move the lever and the slide bar to operate the switch after a predetermined period of time;

a second position in which the lever is movable by hand alone to operate the switch, and a third position in which the lever is urged to operate the switch to operate the conveyor and the spray means until moved in the opposite direction by a conveyed glass engaging a stop member coupled in the slide bar.

7. A washing machine as claimed in claim 6, wherein said means for alternatively moving the pivoted lever comprises a rotatable member rotatable between respective first, second and third positions and a spring connected between the pivoted lever and the rotatable member, in the first position the spring urging the lever to rotate about its pivot for engagement with said timing device, in the second position the spring urging the lever to rotate about its pivot for disengagement from the said timing device, and in the third position the spring urging the said lever and the slide bar in the direction for actuation of the switch for operation of the conveyor and the spray means.

8. A washing machine as claimed in claim 7, wherein the said timing device is a rotatable member rotatable with movement of the conveyor, a peg mounted by the rotatable member for movement in an orbit about the axis of rotation of the rotatable member, and a dog carried by the lever for engagement with the peg for movement thereby to actuate the switch and stop operation of the conveyor and the spray means.

9. A washing machine as claimed in claim 7, wherein the said spring provides an over-centre action to the said rotatable member to maintain it in the position into which it is placed by an operator.

* * * * *